US008733829B2

(12) United States Patent
Liu et al.

(10) Patent No.: US 8,733,829 B2
(45) Date of Patent: May 27, 2014

(54) COMPOSITE CHAIR

(75) Inventors: Lausan Chung-Hsin Liu, Shanghai (CN); Shopo Hsin Tsu Liu, Shanghai (CN); Fibro Tsu Kun Liu, Shanghai (CN)

(73) Assignee: Keysheen Industry (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 13/483,979

(22) Filed: May 30, 2012

(65) Prior Publication Data

US 2013/0320731 A1 Dec. 5, 2013

(51) Int. Cl.
*A47B 85/04* (2006.01)

(52) U.S. Cl.
USPC ..... 297/119; 297/121; 297/144

(58) Field of Classification Search
USPC ..... 297/248, 144, 119–121, 232, 283.2; 108/50.11, 50.14, 145, 84, 96
See application file for complete search history.

(56) References Cited

U.S. PATENT DOCUMENTS

| | | | | | |
|---|---|---|---|---|---|
| D265,952 | S * | 8/1982 | Theodore | D6/336 |
| 4,536,027 | A * | 8/1985 | Brennan | 297/124 |
| 4,926,760 | A * | 5/1990 | Sack | 108/145 |
| 5,588,377 | A * | 12/1996 | Fahmian | 108/145 |
| 6,139,096 | A * | 10/2000 | Anderson et al. | 297/188.1 |
| 6,435,609 | B1 * | 8/2002 | Gasser | 297/188.1 |
| 6,701,853 | B1 * | 3/2004 | Hwang | 108/118 |
| 6,715,831 | B1 * | 4/2004 | Tseng | 297/281 |
| 6,767,056 | B2 * | 7/2004 | Tseng | 297/248 |
| 6,786,829 | B1 * | 9/2004 | Tseng | 472/125 |
| 6,793,282 | B2 * | 9/2004 | Plant et al. | 297/248 |
| 8,002,350 | B2 * | 8/2011 | Johnson | 297/248 |

FOREIGN PATENT DOCUMENTS

| | | | |
|---|---|---|---|
| DE | 202011003252 | U1 | 5/2011 |
| GB | 2254780 | A | 10/1992 |
| TW | 529385 | U | 4/2003 |

* cited by examiner

*Primary Examiner* — Sarah B McPartlin
(74) *Attorney, Agent, or Firm* — Muncy, Geissler, Olds & Lowe, P.C.

(57) ABSTRACT

A composite chair to provide multiple use states includes a frame and at least one carrying portion and one movable portion located on the frame. The movable portion includes a movable deck, two coupling members and an adjustment member. Each of the coupling members has a fastening end hinged on the frame and an action end hinged on the movable deck. The action end has a swivel displacement against the fastening end. The adjustment member includes two guide tracks extended along the movable deck, a linkage bar with two ends held in the guide tracks and two movable arms bridging the linkage bar and movable deck. The linkage bar is movable in the guide tracks to allow the coupling members in the swivel displacement to incorporate with the movable arms to drive the movable deck to move upwards and downwards against the carrying portion to change different use states.

6 Claims, 5 Drawing Sheets

COMPOSITE CHAIR

FIELD OF THE INVENTION

The present invention relates to furniture and particularly to a composite chair that provides multiple use states.

BACKGROUND OF THE INVENTION

In response to smaller living space of modern houses and use convenience many furniture producers have endeavored in innovation to improve ordinary furniture to become composite furniture to provide multiple usages. The composite furniture has special features, such as providing multiple use states through simple assembly transformation or to equip with multiple use states at the same time. Therefore one set of composite furniture can meet various requirements. In general, the composite furniture uses a swivelable frame which can be flipped to change use condition. While it can be maneuvered simply, it requires multiple pivotal elements. This makes assembly more difficult.

The conventional composite furniture, such as R.O.C. utility model patent No. 529385 which discloses a chair with a goods holding rack that can be flipped over. It includes a chair bracket, a chair frame mounted onto the chair bracket, a seat and a goods holding rack installed on the chair frame. The goods holding rack has a swing frame which can be flipped rearwards. The chair frame has a backrest bar at a corresponding position to anchor the swing frame. The swing frame has a rack at the front side that can be positioned horizontally to allow the goods holding rack to hold goods. The swing frame also has a rack leaning end which can be moved to a flipped position to allow the goods holding rack to flip rearwards, thereby users can sit on the seat.

U.K. patent No. GB2254780 discloses another type of composite furniture which is a transformable table chair unit. It includes a chair base and a movable element hinged on the chair base in a swivelable manner. The movable element includes a first position where the chair base is extended upwards from a rear end thereof to become a chair backrest and a second position where the movable element is extended horizontally towards a front end of the chair base to become a table. The table chair unit thus formed can be transformed simply to give users great convenience even outdoors.

Germany publication No. DE202011003252 discloses another type of composite furniture. It has a long bench with a middle portion and two lateral portions. The middle portion is a movable holding deck and includes a first position for seating and a second position to hold goods. It can be maneuvered simply. The bench, aside from seating a third person, also can be transformed to a composite table chair to seat two persons.

The aforesaid conventional composite furniture can provide one or more use states to meet multiple use requirements. They provide many benefits for users who have a lot of furniture but insufficient house space. However, most traditional furniture on the market at present still provides only a single function. For people who require composite function, the choice is still not abundant. On the other hand, much conventional composite furniture has to go through a standard operation procedure to be transformed to different use states. For people who are not familiar with the standard operation procedure operation errors frequently occur and result in damages of the furniture or a dilemma difficult to fix. Hence to provide composite furniture that can be transformed in varying use states via a simple operation procedure still is a need unfulfilled as yet.

SUMMARY OF THE INVENTION

The primary object of the present invention is to provide composite furniture transformable to varying use states through a simple operation procedure to meet two or more use requirements at the same time.

To achieve the foregoing object, the present invention provides a composite chair which includes a frame, at least one carrying portion and one movable portion located on the frame. The movable portion includes a movable deck, two coupling members and an adjustment member. Each of the coupling members has a fastening end hinged on the frame and an action end hinged on the movable deck. The action end can be swiveled about the fastening end in a swivel displacement. The adjustment member is located below the movable deck and includes two guide tracks extended along the movable deck, a linkage bar with two ends held in the guide tracks and two movable arms bridging the linkage bar and movable deck. The linkage bar has a first position in the guide tracks close to a leaning portion and a second position remote from the leaning portion.

The linkage bar can be moved from the first position to the second position to allow the coupling members in the swivel displacement to incorporate with the movable arms to drive the movable deck to move upwards against the carrying portion. The linkage bar also can be moved from the second position to the first position to allow the coupling members in the swivel displacement to incorporate with the movable arms to drive the movable deck to move downwards towards the carrying portion.

In one embodiment the frame includes a leaning portion connecting to the carrying portion. The fastening end of each coupling member is hinged on the leaning portion. The linkage bar is close to the leaning portion at the first position in the guide tracks and remote from the leaning portion at the second position in the guide tracks.

In order to ensure a secure elevation difference between the movable portion and carrying portion to enhance safety, the invention provides two safety measures. One is to provide a retaining notch on the guide track corresponding to the second position of the linkage bar so that two ends of the linkage bar can be latched in the retaining notches to prohibit the linkage bar from moving continuously in the guide tracks. The other is to provide a retaining bar to couple with the guiding tracks. The retaining bar has a safety latch hinged thereon, and each movable arm has a notch mating with the safety latch.

In order to provide suitable support for user's legs, the carrying portion and the movable deck have respectively an arched support section.

In order to keep the movable portion to stay horizontally in varying use states, the movable arm is formed at a length two times of that of the coupling member.

By means of the structure set forth above, compared with the conventional composite furniture, the invention provides many advantages, notably:

1. Simpler operation. The composite chair of the invention has two coupling members and two movable arms to form a four-bar linkage structure so that the movable deck of the movable portion can be moved upwards and downwards against the carrying portion to change different use states. Thus no complicated operation procedure is needed. Even a novice user can easily maneuver.

2. Improved safety and reliability. The composite furniture of the invention provides two safety measures: first, the two guide tracks have respectively a retaining notch corresponding to the second position of the linkage bar to avoid the linkage bar from moving in the guide track; second, a retaining bar is provided to connect to each guide track. The retaining bar has a safety latch, and each movable arm has a notch mating with the safety letch. Through the aforesaid two safety measures, the movable deck can be prevented from dropping from a higher position when is subject to a small external force to injure user's hands.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
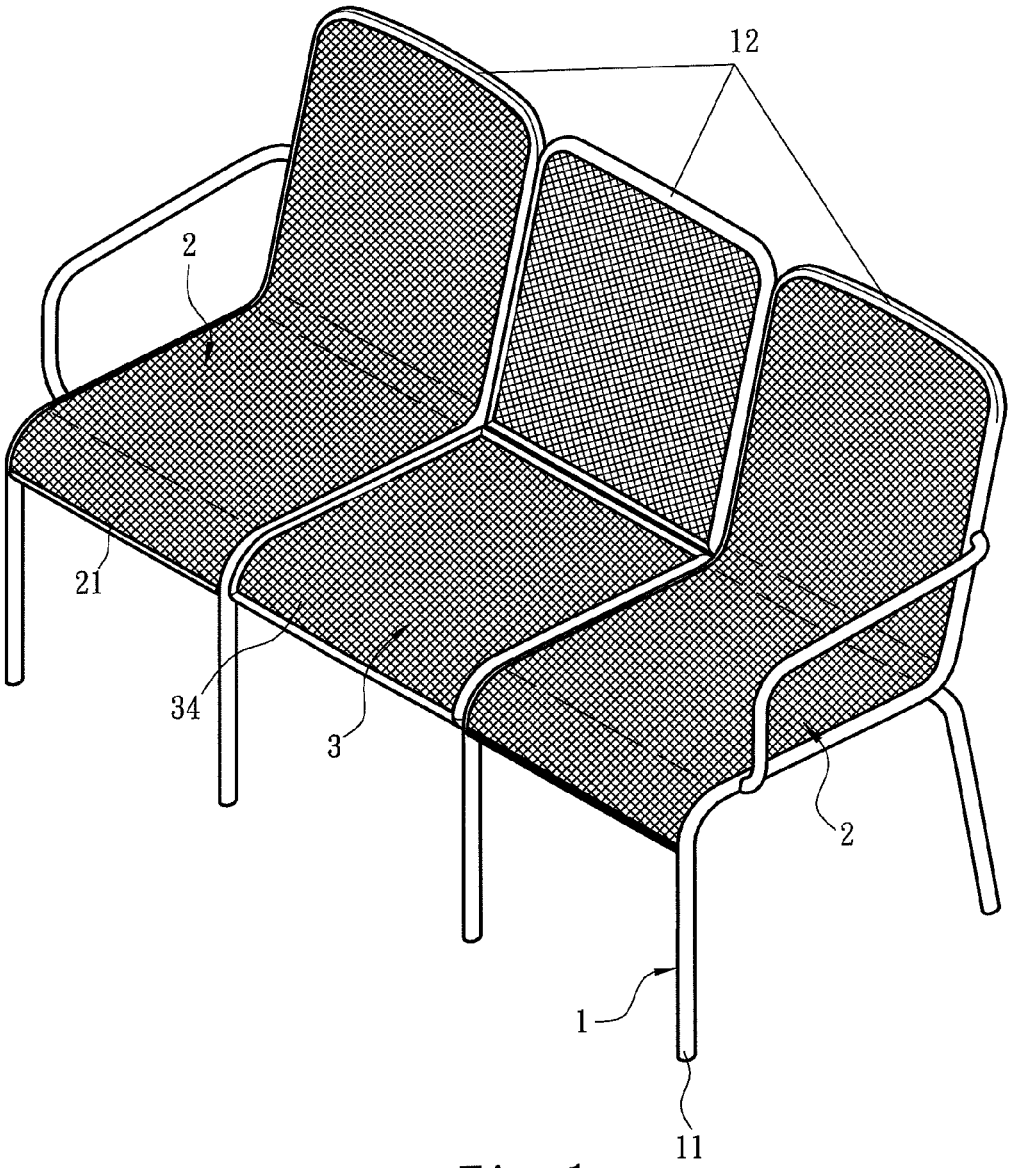
FIG. 1 is a perspective view of an embodiment of the invention in a first use state.
Figure 2:
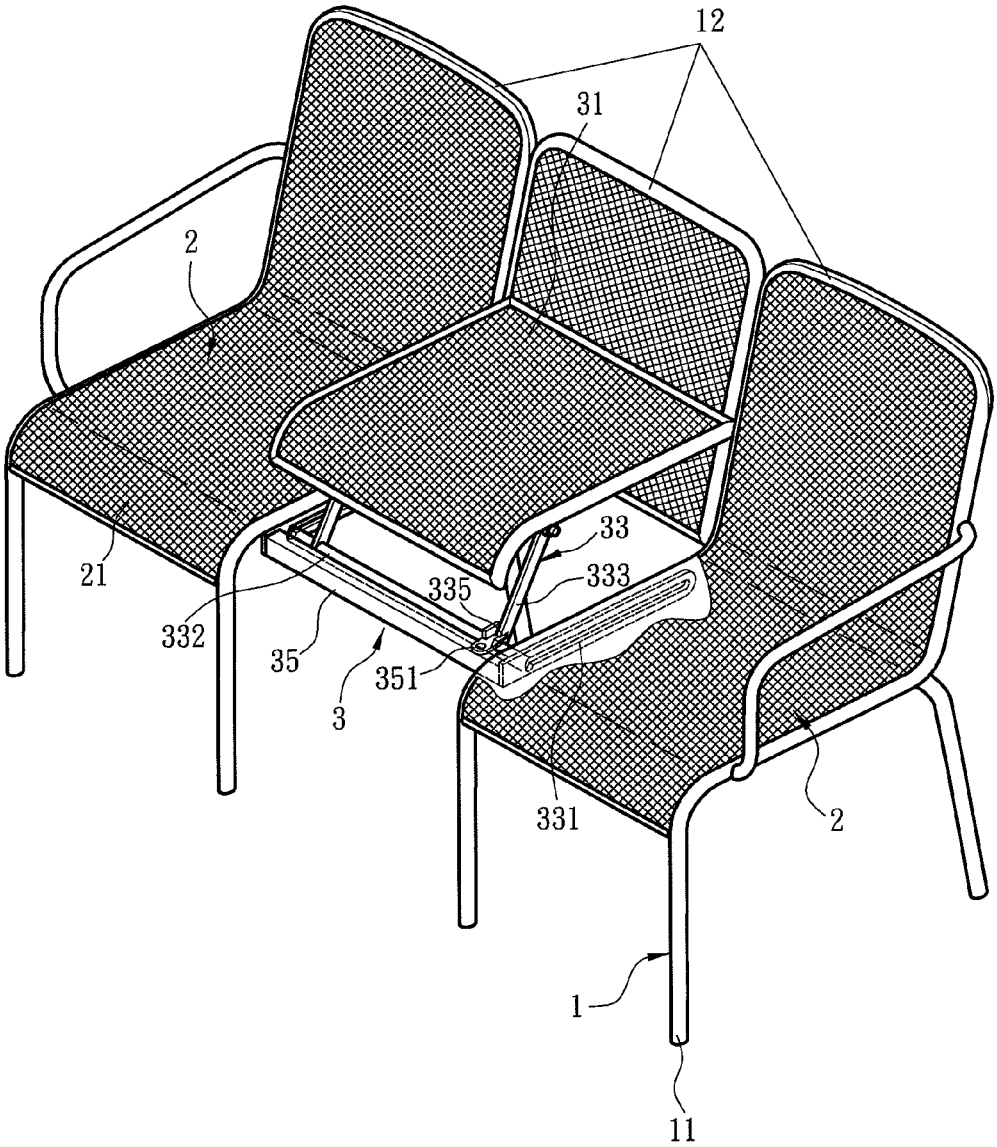
FIG. 2 is a perspective view of an embodiment of the invention in a second use state.

Please refer to FIGS. 1 and 2 for an embodiment of the composite chair of the invention. It includes a frame 1, and at least one carrying portion 2 and one movable portion 3 located on the frame 1. The frame 1 has a leaning portion 12 connecting to the carrying portion 2. The number of the carrying portion 2 and movable portion 3 can be changed according to different use requirements. In this embodiment, the frame 1 includes a plurality of legs 11 to allow the composite chair to be securely rested on a flat surface. The carrying portion 2 and movable portion 3 can be sat by users. The leaning portion 12 provides the users a comfortable leaning effect and allows the legs of the users to rest naturally at the edges of the carrying portion 2 and movable portion 3. The carrying portion 2 and movable portion 3 have respectively a support section 21 or 34 extended in an arched fashion.

The movable portion 3 is movable and includes a movable deck 31 which can be moved against the carrying portion 2 to change the relative elevation between the movable deck 31 and carrying portion 2 and to position the movable portion 3 at a first use state and a second use state. In the first use state, referring to FIG. 1, the movable portion 3 allows the users to sit thereon. In the second use state, referring to FIG. 2, the movable portion 3 can hold goods.

Figure 3A:
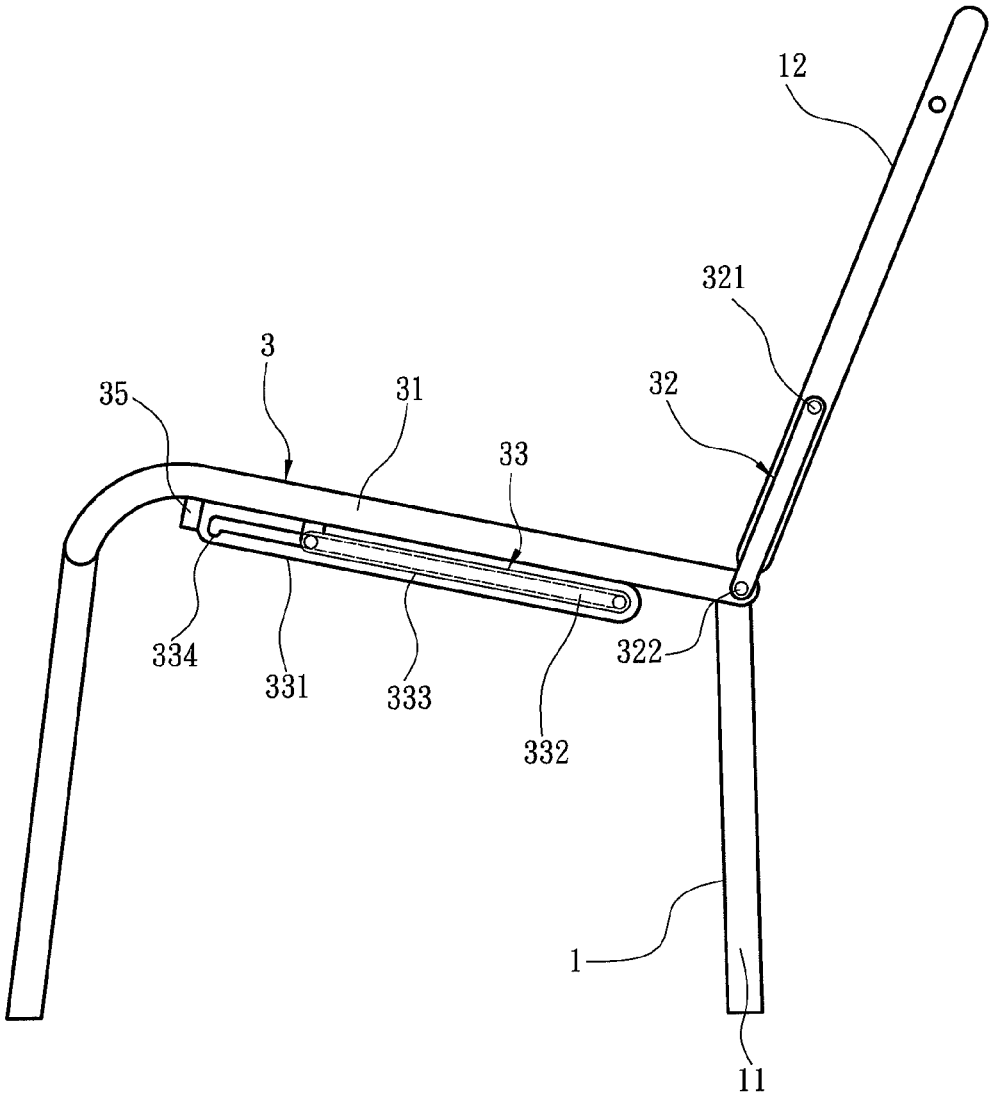
FIG. 3A is a schematic side view of an embodiment of the invention in operating condition-1.

Please referring to FIGS. 2 and 3A, the movable portion 3 includes two coupling members 32. FIG. 3A is a side view shown only one coupling member 32 at one side of the leaning portion 12, while another coupling member 32 is located at another side of the leaning portion 12. Each of the two coupling members 32 has a fastening end 321 hinged on the leaning portion 12 of the frame 1 in a swivelable manner and an action end 322 hinged on the movable deck 31 in a swivelable manner. The action end 322 can be swiveled about the fastening end 321 in a swivel displacement, i.e., the coupling member 32 can swivel about the fastening end 321 as an axis to drive the movable deck 31 to move via the action end 322.

The movable member 31 further includes an adjustment member 33 located below the movable deck 31. The adjustment member 33 has two guide tracks 331 extended along the movable deck 31 and a linkage bar 332 with two ends held in the two guide tracks 331. The linkage bar 332 is coupled with two movable arms 333 close to two ends thereof. Each movable arm 333 has one end fastened to the linkage bar 332 and another end hinged on the movable deck 31 in a swivelable manner. Preferably, the two guide tracks 331 are located respectively at one side of the carrying portion 2. To facilitate discussion of the movement of the moveable member 3, the linkage bar 332 is defined with a first position and a second position at two ends of the guide tracks 331. At the first position the linkage bar 332 is in the guide track 331 close to the leaning portion 12, and at the second position the linkage bar 332 is in the guide tracks 331 remote from the leaning portion 12. Each guide track 331 has a retaining notch 334 corresponding to the linkage bar 332 at the second position.

Please refer to FIGS. 1 and 3A for the moveable portion 3 in a moving condition. First, in the first use state, the movable deck 31 is located at a horizontal plane the same as the carrying portion 2, and then the composite chair can seat three persons. The linkage bar 332 is located in the guide tracks 331 at the first position close to the leaning portion 12, and the action ends 322 of the coupling members 32 position the movable deck 31 at an elevation the same as the carrying portion 2.

Figure 3B:
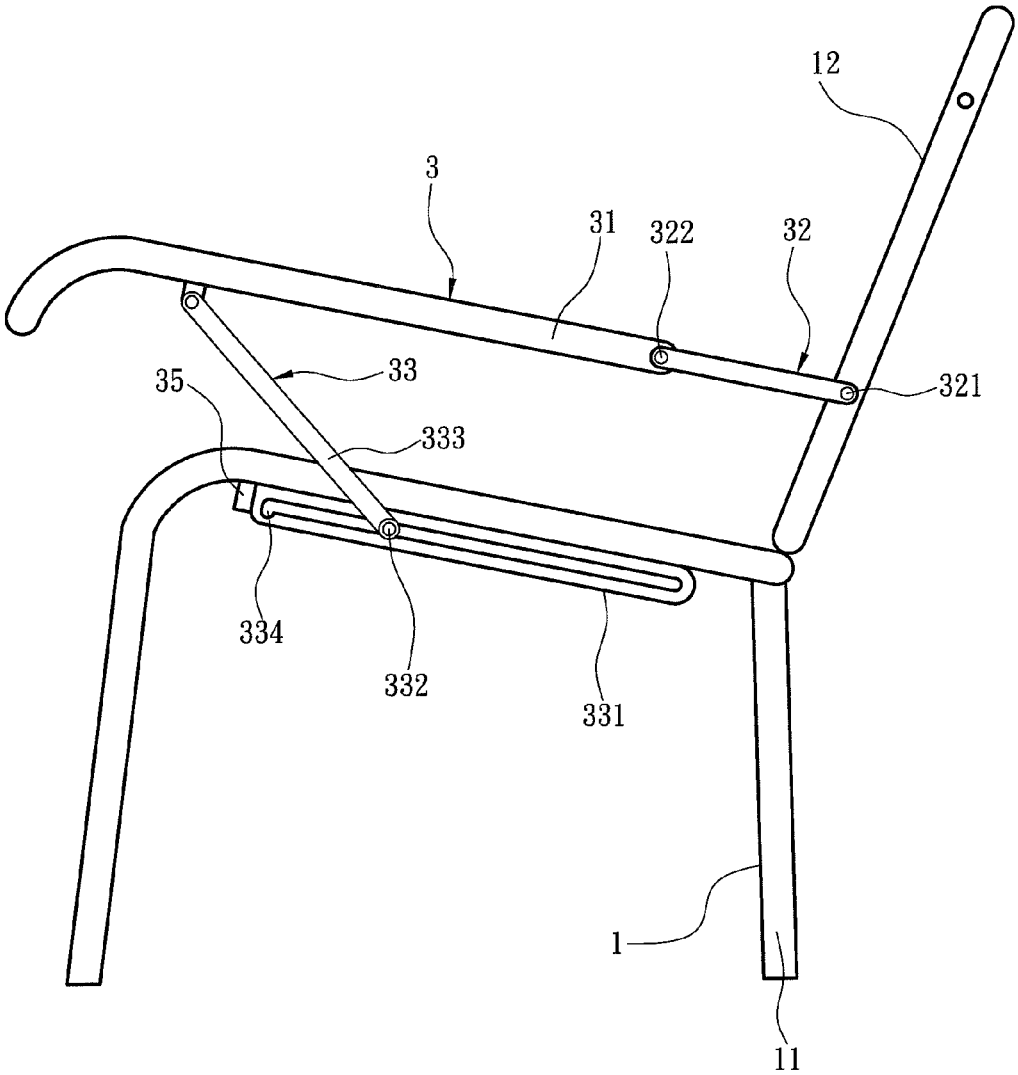
FIG. 3B is a schematic side view of an embodiment of the invention in operating condition-2.
Figure 3C:
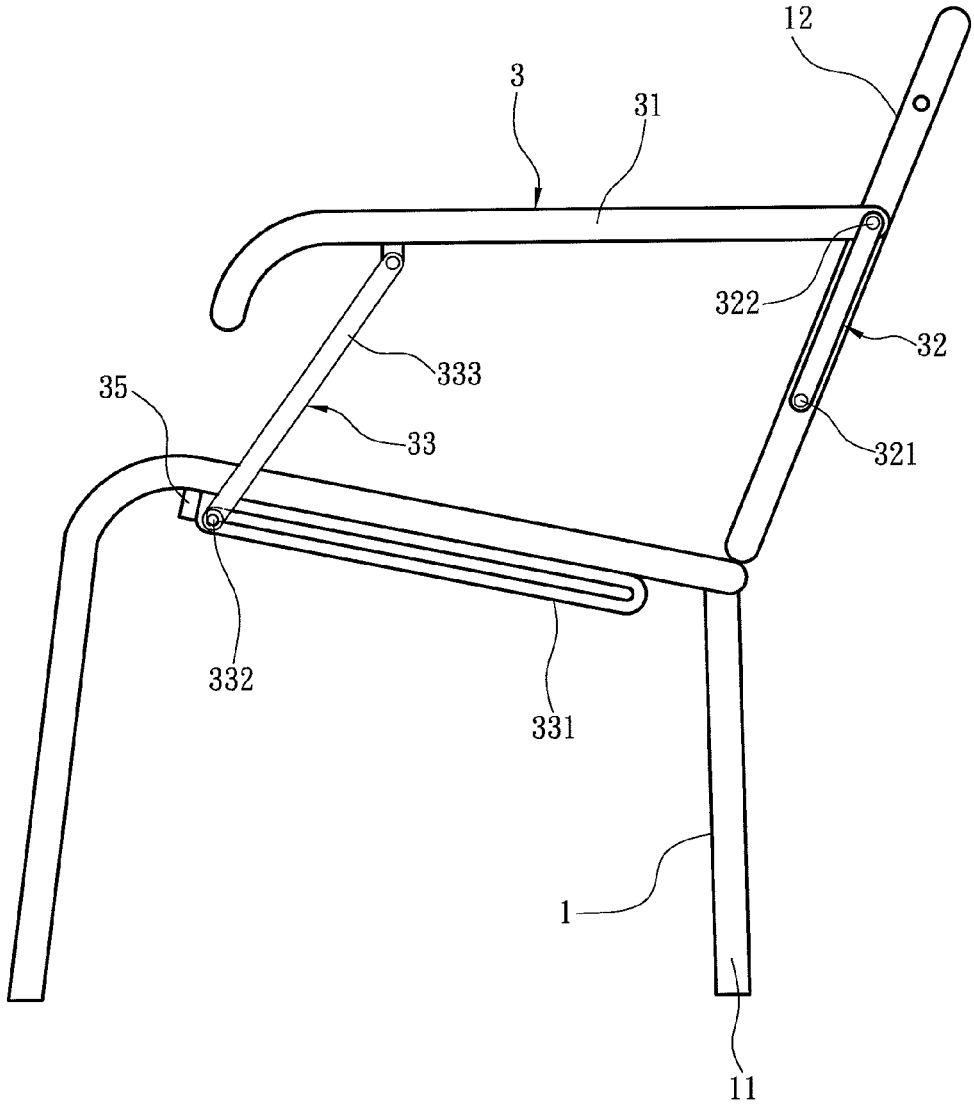
FIG. 3C is a schematic side view of an embodiment of the invention in operating condition-3.

Referring to FIGS. 3B and 3C, in the event that holding goods is desired, the movable deck 31 can be raised. To achieve this purpose, the linkage bar 332 is moved in the guide tracks 331 from the first position to the second position that is remote from the leaning position 12; meanwhile, the movable arms 333 drive one end of the movable deck 31 to move upwards and the coupling members 32 in the swivel displacement also drive another end of the movable deck 31 to move upwards until the movable deck 31 is stopped by the leaning portion 12 (referring to FIG. 2). When the linkage bar 332 is moved to the second position two ends of the linkage bar 332 are latched in the two retaining notches 334, hence the linkage bar 332 cannot move further in the two guide tracks 331 and safety in use can be enhanced. Also referring to FIG. 2, the two guide tracks 331 further are connected to a retaining bar 35 with a safety latch 351 hinged thereon. Each movable arm 333 has a notch 335 mating with the safety latch 351. When the linkage bar 332 is moved to the second position, the safety latch 351 is latched in the notch 335 to prevent the movable arm 333 from moving continuously.

Finally, when the four corners of the movable deck 31 are raised by the four linkage bars consisting of the two movable arms 333 and two coupling members 32, the composite chair is at the second use state that can hold goods and also can seat two persons. In this embodiment, the movable arm 333 is formed at a length substantially two times of that of the coupling member 32, hence the movable deck 31 can maintain horizontal in the first and second use states.

When returning the composite chair to the first use state is desired, the linkage bar 332 escapes from the retaining notches 334 and moves from the second position to the first position; meanwhile, the movable arms 333 drive one end of the movable deck 31 downwards, and the coupling members 32 in the swivel displacement also drive another end of the movable deck 31 downwards; finally, the movable deck 31 returns to the same horizontal level as the carrying portion 2 and the composite chair returns to the first use state.

As a conclusion, the composite chair of the invention includes a frame and at least one carrying portion and one movable portion located on the frame. The movable portion includes a movable deck, two coupling members and an adjustment member. The coupling members are hinged on the frame and movable deck. The adjustment member includes two guide tracks, a linkage bar held in the two guide tracks and two movable arms to bridge the linkage bar and movable deck. As the linkage bar is moved in the two guide tracks, the movable deck is driven by the four-bar linkage structure consisting of the two movable arms and two coupling members to move against the carrying portion so that the composite chair has a first and second use states.

Compared with the conventional chair which provides only a single use state, the composite chair of the invention can provide two use states to meet multiple requirements. Compared with the conventional composite furniture, the invention also provides a four-bar linkage structure to drive the movable deck upwards and downwards. Operation is simpler. It provides significant improvements over the conventional techniques.

While the preferred embodiment of the invention has been set forth for the purpose of disclosure, it is not the limitation of the invention, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A composite chair, comprising a frame and at least one carrying portion and one movable portion located on the frame, wherein the movable portion includes:

a movable deck;

two coupling members each including a fastening end hinged on the frame and an action end hinged on the movable deck, the action end being swivelable about the fastening end in a swivel displacement; and an adjustment member which is located below the movable deck and includes two guide tracks extended along the movable deck, a linkage bar with two ends held in the two guide tracks, and two movable arms to bridge the linkage bar and the movable deck, the linkage bar including a first position and a second position at two ends of each of the two guide tracks;

wherein the linkage bar is movable from the first position to the second position to allow the two coupling members to swivel and drive the movable deck to move upwards away from the at least one carrying portion; and wherein the linkage bar is movable from the second position to the first position to allow the two coupling members to swivel and drive the movable deck to move downwards towards the at least one carrying portion, and wherein each of the two movable arms is formed at a length two times of that of each of the two coupling members.

2. The composite chair of claim 1, wherein each of the two guide tracks includes a retaining notch corresponding to the linkage bar at the second position, and one end of the linkage bar is latched in the retaining notch at the second position to prohibit the linkage bar from moving in the guide track.

3. The composite chair of claim 1 further including a retaining bar connected to the two guide tracks, the retaining bar including a safety latch hinged thereon, each of the two movable arms including a notch mating with the safety latch.

4. The composite chair of claim 1, wherein the frame includes a leaning portion connected to the at least one carrying portion, the fastening end of one coupling member being hinged on the leaning portion.

5. The composite chair of claim 4, wherein the linkage bar at the first position in the two guide tracks is proximate the leaning portion, and wherein the linkage bar at the second position in the two guide tracks remote from the leaning portion.

6. The composite chair of claim 1, wherein the at least one carrying portion and the movable portion include respectively an arched support section.

* * * * *